US009404294B1

(12) United States Patent
Mitchell et al.

(10) Patent No.: US 9,404,294 B1
(45) Date of Patent: Aug. 2, 2016

(54) ASTRAGAL WITH ADJUSTABLE LENGTH SHOOT BOLT DRIVE LINKAGE

(71) Applicant: Endura Products, Inc., Colfax, NC (US)

(72) Inventors: Mike Mitchell, Winston-Salem, NC (US); George Heid, Charlotte, NC (US)

(73) Assignee: Endura Products, Inc., Colfax, NC (US)

( * ) Notice: Subject to any disclaimer, the term of this patent is extended or adjusted under 35 U.S.C. 154(b) by 236 days.

(21) Appl. No.: 14/159,846

(22) Filed: Jan. 21, 2014

(51) Int. Cl.

| | |
|---|---|
| ***E05C 1/02*** | (2006.01) |
| ***E05C 9/20*** | (2006.01) |
| ***E05C 9/10*** | (2006.01) |
| ***E05B 63/06*** | (2006.01) |
| ***E05B 63/00*** | (2006.01) |
| *E05C 7/04* | (2006.01) |
| *E05C 9/04* | (2006.01) |

(52) U.S. Cl.
CPC ..... *E05C 1/02* (2013.01); *E05B 63/0056* (2013.01); *E05B 63/06* (2013.01); *E05C 9/10* (2013.01); *E05C 9/20* (2013.01); *E05C 7/045* (2013.01); *E05C 9/046* (2013.01); *Y10S 292/21* (2013.01); *Y10S 292/54* (2013.01); *Y10S 292/60* (2013.01); *Y10S 292/64* (2013.01)

(58) Field of Classification Search
CPC ..... E05C 1/02; E05C 7/04; E05C 7/045; E05C 9/04; E05C 9/046; E05C 9/10; E05C 9/20; E05B 63/0017; E05B 63/0056; E05B 63/06; Y10T 292/0963; Y10T 292/1015
USPC ..... 292/137, 156, 158, 139, DIG. 21, 292/DIG. 54, DIG. 60, DIG. 64; 70/107–109, 70/461
See application file for complete search history.

(56) References Cited

U.S. PATENT DOCUMENTS

| | | | | | |
|---|---|---|---|---|---|
| 535,278 | A | * | 3/1895 | Downing | F16B 21/02 403/348 |
| 618,305 | A | | 1/1899 | Weaver | |
| 635,833 | A | * | 10/1899 | Woodward | E21B 17/046 403/353 |
| 684,732 | A | * | 10/1901 | Villard | F16B 21/09 15/104.31 |
| 826,943 | A | | 6/1906 | Gilleland | |

(Continued)

FOREIGN PATENT DOCUMENTS

| | | | | | |
|---|---|---|---|---|---|
| GB | 2298450 | A | * | 9/1996 | E05C 9/20 |
| GB | 2363625 | A | * | 1/2002 | E05C 9/20 |

OTHER PUBLICATIONS

Endura Performance Standard Multi-Point Compatible W&F brochure, known at least as early as Jan. 20, 2014, 2 pgs.

(Continued)

*Primary Examiner* — Kristina Fulton
*Assistant Examiner* — Christine M Mills
(74) *Attorney, Agent, or Firm* — Womble Carlyle Sandridge & Rice, LLP

(57) ABSTRACT

An adjustable length astragal having a housing with an upper shoot bolt and a lower shoot bolt positioned adjacent opposite ends of the housing. An actuator is attached to the housing, connected to and configured to simultaneously extend or retract the upper and lower shoot bolts. An adjustable connection assembly is provided between the actuator and at least one of the shoot bolts. The connection assembly adjusts the distance between the actuator and the respective shoot bolt in each of the shoot bolt's extended and retracted positions.

21 Claims, 19 Drawing Sheets

(56) References Cited

U.S. PATENT DOCUMENTS

| | | | | | |
|---|---|---|---|---|---|
| 1,077,433 | A | | 11/1913 | Schlis | |
| 1,334,314 | A | | 3/1920 | Parsons | |
| RE15,619 | E | | 6/1923 | Massoll | |
| 1,488,612 | A | * | 4/1924 | Phillips | E05C 9/22 292/139 |
| 2,406,459 | A | | 8/1946 | Gibson | |
| 2,586,900 | A | | 2/1952 | Alderman | |
| 2,610,368 | A | | 9/1952 | Tschaepe | |
| 3,211,850 | A | | 10/1965 | Toepfer | |
| 3,649,060 | A | | 3/1972 | Ruff | |
| 3,656,788 | A | | 4/1972 | Emery | |
| 3,788,679 | A | | 1/1974 | Banham | |
| 3,788,687 | A | | 1/1974 | Zawadzki | |
| 4,428,153 | A | | 1/1984 | Klinger et al. | |
| 4,429,493 | A | | 2/1984 | St. Aubin | |
| 4,644,696 | A | | 2/1987 | Bursk | |
| 4,881,765 | A | * | 11/1989 | Heid | E05C 9/20 292/92 |
| 4,999,950 | A | | 3/1991 | Beske | |
| 5,197,771 | A | | 3/1993 | Kaup | |
| 5,290,077 | A | | 3/1994 | Fleming | |
| 5,328,217 | A | | 7/1994 | Sanders | |
| 5,350,207 | A | | 9/1994 | Sanders | |
| 5,524,942 | A | | 6/1996 | Fleming | |
| 5,590,919 | A | | 1/1997 | Germano | |
| 5,777,266 | A | * | 7/1998 | Herman | H02G 9/02 138/155 |
| 5,782,114 | A | | 7/1998 | Zeus | |
| 5,791,700 | A | | 8/1998 | Biro | |
| 5,857,291 | A | | 1/1999 | Headrick | |
| 5,906,403 | A | | 5/1999 | Bestler | |
| 6,009,732 | A | | 1/2000 | Haeck et al. | |
| 6,131,966 | A | | 10/2000 | Hensley et al. | |
| 6,164,863 | A | * | 12/2000 | Hedley | F16B 5/0607 24/573.11 |
| 6,282,929 | B1 | | 9/2001 | Eller | |
| 6,457,751 | B1 | | 10/2002 | Hartman | |
| 6,491,326 | B1 | | 12/2002 | Massey et al. | |
| 6,574,927 | B2 | * | 6/2003 | Van Parys | E05C 9/20 52/204.51 |
| 6,966,585 | B2 | | 11/2005 | Egi et al. | |
| 6,971,686 | B2 | | 12/2005 | Becken | |
| 6,994,383 | B2 | | 2/2006 | Morris | |
| 7,000,959 | B2 | | 2/2006 | Sanders | |
| 7,036,854 | B1 | | 5/2006 | Lai | |
| 7,144,053 | B2 | | 12/2006 | Bashford | |
| 7,267,379 | B2 | | 9/2007 | Rusiana | |
| 7,350,336 | B2 | * | 4/2008 | Bennett | E06B 1/70 49/467 |
| 7,452,014 | B2 | * | 11/2008 | Vetter | E05B 17/0025 292/302 |
| 7,641,244 | B2 | | 1/2010 | Lin | |
| 7,669,902 | B2 | | 3/2010 | Orbeta | |
| 7,722,097 | B2 | | 5/2010 | Schnarr et al. | |
| 7,735,882 | B2 | | 6/2010 | Abdollahzadeh et al. | |
| 7,752,875 | B2 | | 7/2010 | Constantinou et al. | |
| 7,900,981 | B2 | | 3/2011 | Hirschoff | |
| 7,942,458 | B2 | | 5/2011 | Patterson | |
| 8,157,298 | B2 | | 4/2012 | Mitchell et al. | |
| 2005/0120631 | A1 | | 6/2005 | Sanders | |
| 2006/0145488 | A1 | | 7/2006 | Wittke et al. | |
| 2007/0001469 | A1 | | 1/2007 | Balbo Di Vinadio | |
| 2007/0029812 | A1 | | 2/2007 | Monts De Oca | |
| 2007/0283629 | A1 | | 12/2007 | Phipps | |
| 2008/0087052 | A1 | | 4/2008 | Abdollahzadeh et al. | |
| 2010/0066102 | A1 | * | 3/2010 | Shen | E05B 65/1006 292/92 |
| 2012/0001443 | A1 | * | 1/2012 | Mitchell | E05B 63/242 292/341.16 |
| 2013/0004264 | A1 | * | 1/2013 | Millet | F16B 5/0233 411/535 |

OTHER PUBLICATIONS

Endura Performance Standard "What Does Performance Standard Mean for You?", Ultimate Astragal Family brochure, known at least as early as Jan. 20, 2014, 5 pgs.

* cited by examiner

ASTRAGAL WITH ADJUSTABLE LENGTH SHOOT BOLT DRIVE LINKAGE

FIELD OF THE INVENTION

The invention generally relates to locks for double doors, and more particularly relates to an astragal for securing a swinging door panel in a closed position.

BACKGROUND

Exterior entryways of modern homes and buildings often include cooperating pairs of swinging doors commonly referred to as double doors or French doors. Such doors include an inactive swinging door panel, and an adjacent active swinging door panel. The sets of doors may swing inwardly into the structure (so-called "inswing" doors), or may swing outwardly from the structure (so-called "outswing" doors). The inactive door panel typically includes a generally T-shaped astragal mounted along the entire extent of its non-hinged vertical edge. As used herein, the term "astragal" generally means an elongated member attached to and substantially coextensive with the non-hinged vertical edge of one of a pair of swinging double doors. In a conventional arrangement, an astragal is mounted along the non-hinged vertical edge of an inactive door panel, and provides a stop against which a cooperating active door panel strikes when both door panels are closed.

In its simplest form, an astragal consists of a single length of wooden molding attached along the non-hinged edge of an inactive door panel by screws, nails, or the like. Such simple astragals serve no role in fixing an inactive swinging door panel in a closed position in a doorway. Instead, special unrelated locking hardware is required for that purpose. Such locking hardware can be internally mounted within specially formed pockets or recesses within the housing of the inactive door panel or the astragal. Such pockets or recesses must be specially formed in the edge of the door by routing, milling, chiseling, or the like. The locking hardware typically includes independently operable top and bottom shoot bolts which are received in specially drilled bores in the top and bottom of the inactive door panel proximate to the door panel's non-hinged vertical edge. When extended, the top and bottom shoot bolts selectively engage aligned pockets or holes in the top jamb and doorsill of the associated doorway, thereby fixing the inactive door panel in a closed position. When retracted, the top and bottom shoot bolts permit the inactive door panel to swing open. Both the top and bottom shoot bolts typically are actuated by either a slide or lever mechanism either integral with the shoot bolts or installed along the non-hinged vertical edge of the inactive door panel.

Some modern astragals for inactive door panels include vertically moveable top and bottom shoot bolts disposed in a flush-mounted elongated housing. One such astragal is described in U.S. Pat. No. 6,491,326 to Endura Products, Inc., for example. Like the simple astragal described above, the housing of such locking astragals is surface-mounted along the non-hinged vertical edge of an inactive door panel, and provides a stop for a cooperating active door panel. When the inactive panel is closed and the top and bottom shoot bolts are vertically extended, the top and bottom shoot bolts are respectively received in pockets or holes in the top jamb and doorsill of the associated doorway, thereby fixing the inactive panel in a closed position. In order to permit the inactive panel to be opened, the top and bottom shoot bolts can be selectively retracted from their associated pockets or holes in the doorframe. The top and bottom shoot bolts can be vertically extended and retracted by a lever or slide actuating mechanism disposed within the housing. Unlike shoot bolt mechanisms that must be internally installed within specially formed recesses or pockets in a door, such locking astragals can be removably installed relatively easily on a substantially planar external surface or surfaces of an inactive door panel.

FIG. 1 illustrates a typical double door entryway with an astragal. The entryway 11 includes an entryway frame or casing defined by spaced apart vertical jambs 12 and 13 and a horizontal head jamb or header 14. A threshold and sill assembly 16 spans the bottom of the jambs 12 and 13 to complete the entryway frame. A normally inactive door 17 is hinged to the left hand (as seen from the outside of the entryway) jamb 12 and a normally active door 18 is hinged to the right hand jamb 13. Of course, the normally inactive door just as well can be mounted to the right hand jamb with the normally active door mounted to the left-hand jamb. An astragal 19 is mounted to and extends along the vertical inside edge of the normally inactive door 17. The astragal 19, which historically is made of wood but that can be made of metal or other materials, has a generally T-shaped cross section and provides a vertically extending stop against which the active door 18 can close. Flush bolts (not visible in FIG. 1) usually are slidably disposed at the top and bottom of the astragal and are extendable into the head jamb 14 and the threshold and sill assembly 16 to secure the normally inactive door 17 in its closed position. In this way, the normally inactive door, which is opened only occasionally, is secured in its closed position to provide a solid stop for the normally active door and to provide security against a would-be thief. A strike plate 21 and a deadbolt strike 22 are mounted to the inside edge of the astragal 19 and are aligned to receive the latch and deadbolt of the normally active door when closed in the usual way. Weather stripping (not visible) typically is provided along the stop provided by the astragal 19 to seal against drafts and blown rainwater when the normally active door is closed against the stop.

SUMMARY

The inventors have determined there is a need for an astragal with shoot bolts whose separation can be adjusted. Particularly, there is a need for an astragal that can be adjusted to the height of the door on which it will be installed.

While modern locking astragals can be removably installed to external surfaces of an inactive door panel, these astragals must be provided in several lengths to accommodate the variety of doorway heights found in the marketplace. The internal locking assemblies used to control the shoot bolts have conventionally been prefabricated based on the height of the door onto which the astragal is going to be installed, resulting in a fixed distance between the top and bottom shoot bolts in their respective extended and retracted positions. Any attempt to substantially shorten the astragal would be impeded by the rigid drive bars used to extend between the actuator, located generally near the middle of the astragal, and the shoot bolts on each end. Generally a lever actuator is in a fixed location and the drive bars are a discrete length. Shortening these locking astragals would therefore require complete disassembly, cutting of the parts and reassembling.

Thus, embodiments of the present disclosure include an adjustable length astragal having a housing with an upper shoot bolt and a lower shoot bolt positioned adjacent opposite ends of the housing. An actuator is attached to the housing, connected to and configured to simultaneously extend or retract the upper and lower shoot bolts. An adjustable connection assembly is provided between the actuator and at least one of the shoot bolts, where the connection assembly adjusts the distance between the actuator and the respective shoot bolt in each of the shoot bolt's extended and retracted positions.

Further embodiments of the present disclosure include selectively removable interlocking links for use in the adjustable length astragal. The links comprise a body having a front side, a back side, a first end surface, a second end surface, and a rotational axis passing through each of the end surfaces. A pair of tabs extends from the first end surface, offset from the rotational axis. A front clamping pocket is formed on the front side, and a back clamping pocket is formed on the back side. Rotation of the body by 90 degrees or less about the rotational axis R interlocks one link with an adjacent link such that each tab of the pair of tabs engages a respective one of the front and back clamping pockets.

DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
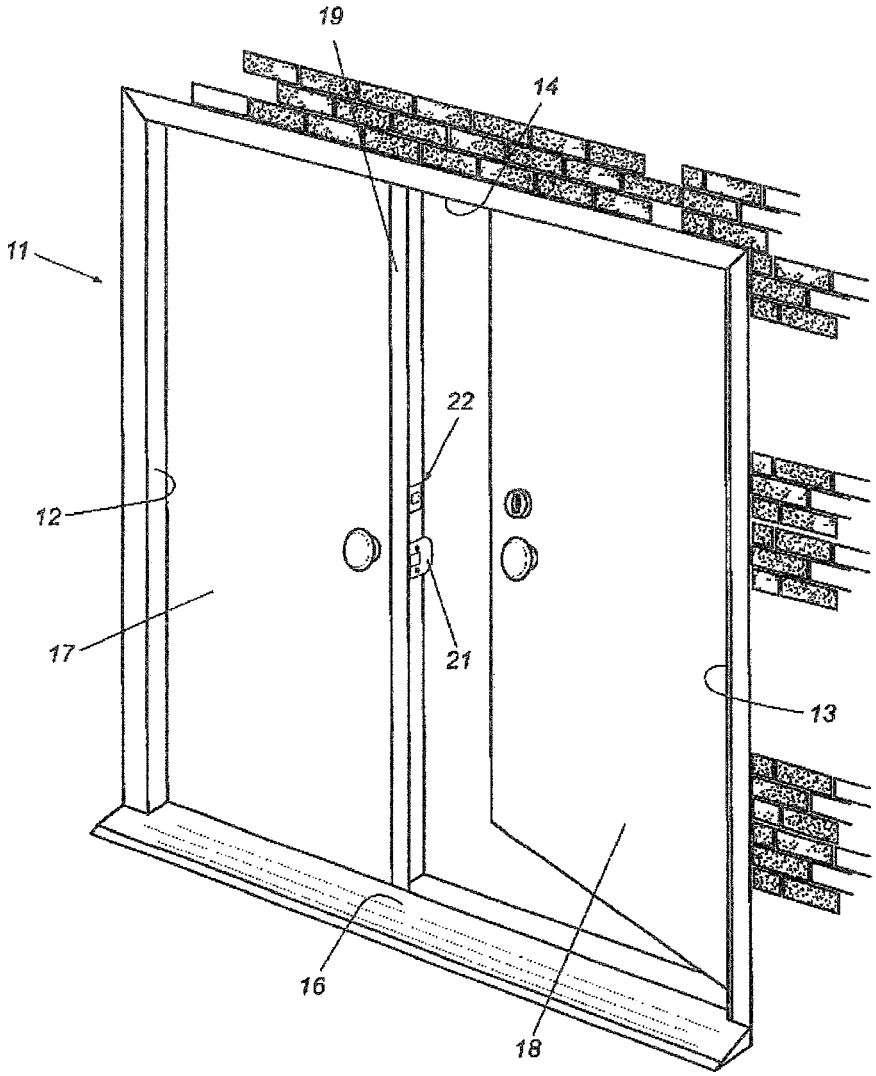
FIGURE 1 PRIOR ART
FIG. 1 is a perspective view of a conventional French door entryway including a conventional astragal.
Figure 2:
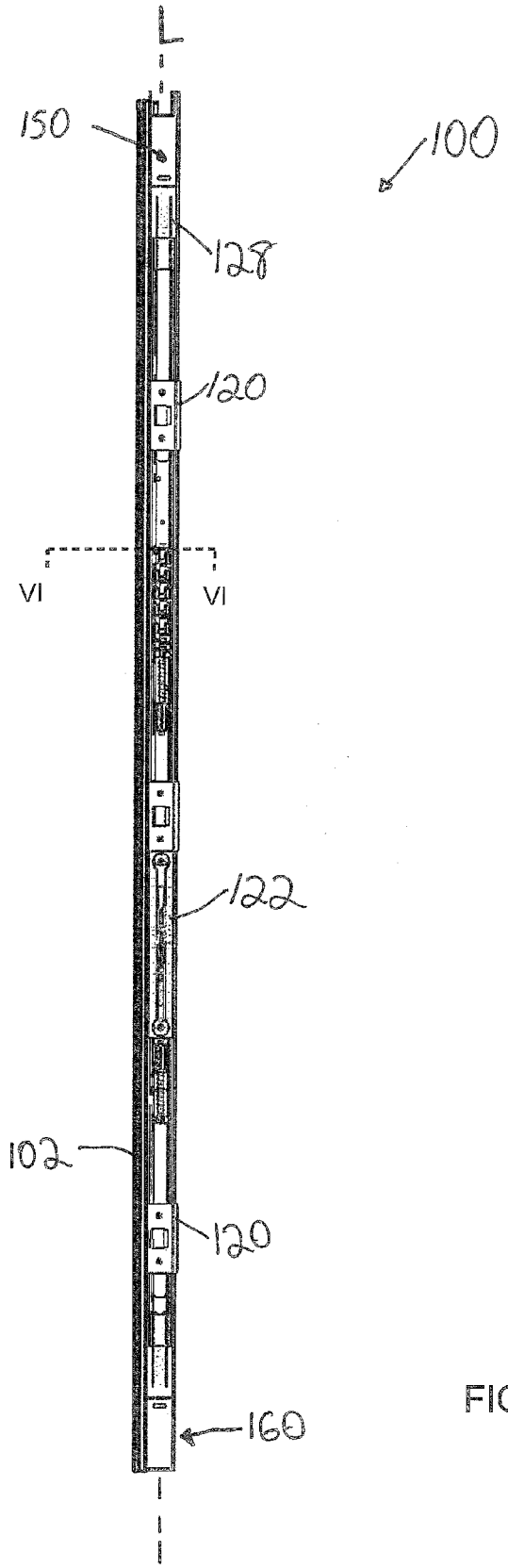
FIG. 2 is an exposed-side view of the assembled astragal according to embodiments of the present disclosure.

One embodiment of a locking astragal 100 for an inactive door panel is shown in FIG. 2. As shown in FIG. 2, the astragal 100 can include an elongated housing 102 defining a longitudinal axis L. The housing 102 may be an extrusion of substantially constant cross section, or may be formed by other known methods. The housing 102 positions an upper shoot bolt assembly 150 at an upper end thereof and a lower shoot bolt assembly 160 at a lower end. A shoot bolt actuator 122 can be provided for selectively, and simultaneously, extending and retracting the shoot bolts of the shoot bolt assemblies 150, 160 relative to the ends of the housing 102. In the embodiment illustrated, the shoot bolt actuator 122 is a lever-type actuator generally known in the art.

At least one strike plate 120 can be positioned along the housing 102 to receive respective latches from a cooperating active door panel (not shown). The astragal 100 may also include a dead bolt plate for receiving a deadbolt from a cooperating active door panel. One or more housing trim plates 128 can be provided between the various exposed components (actuator 122, strike plates 120, dead bolt plate, and shoot bolt assembles 150, 160) to provide the exposed side of the astragal 100 with a finished appearance. These trim plates 128 may be snap-fit to the exposed side of the astragal housing 102. In a preferred embodiment, the strike plates 120 and the optional dead bolt plate can be adjustable along the length of the housing 102 to ensure proper alignment with respective latch bolts.

Figure 3A:
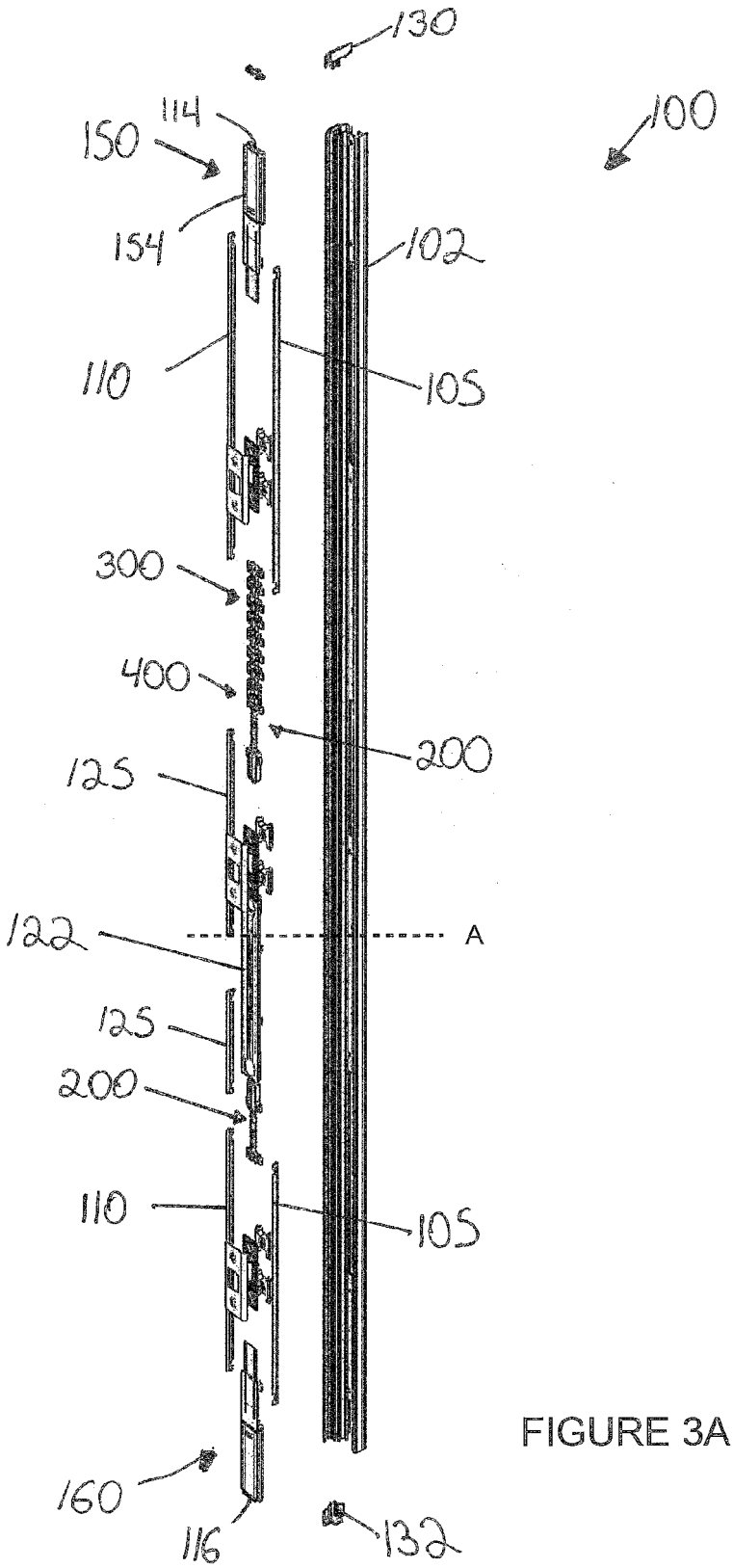
FIG. 3A is an exploded view of an astragal assembly according to embodiments of the present disclosure.
Figure 3B:
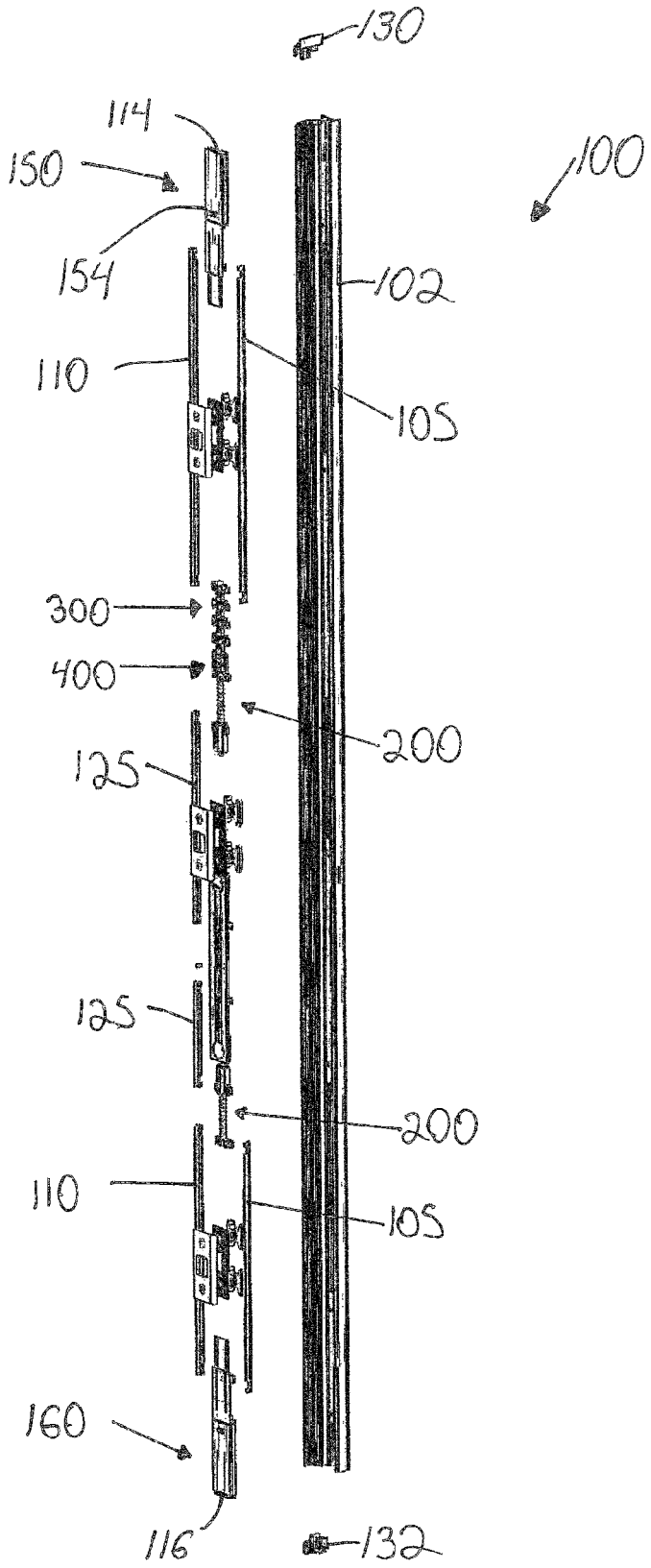
FIG. 3B is an exploded view of a shortened embodiment of the astragal of FIG. 3A.
Figure 3C:
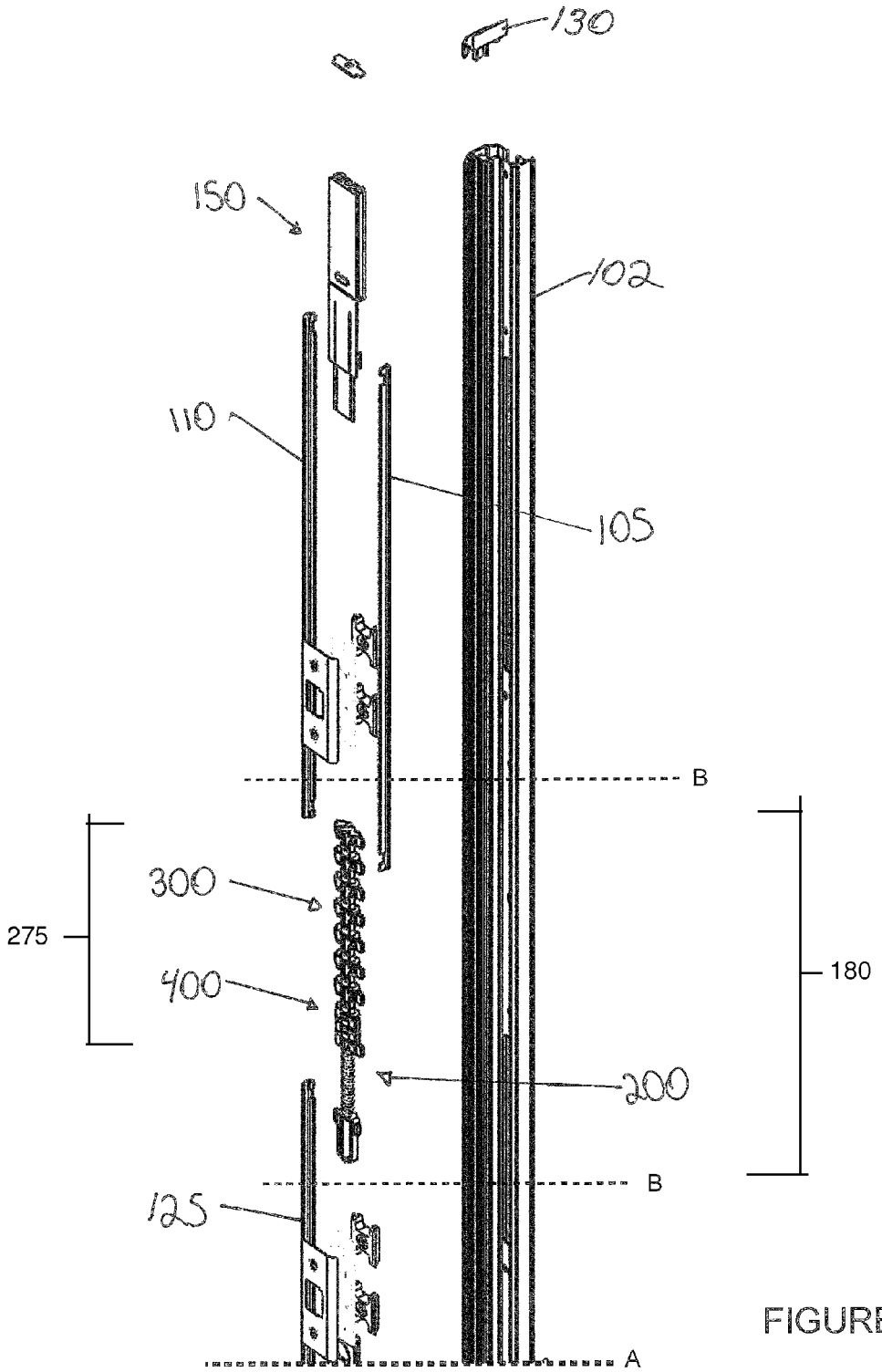
FIG. 3C is a detailed view of the astragal of FIG. 3A above cut-line A.
Figure 3D:
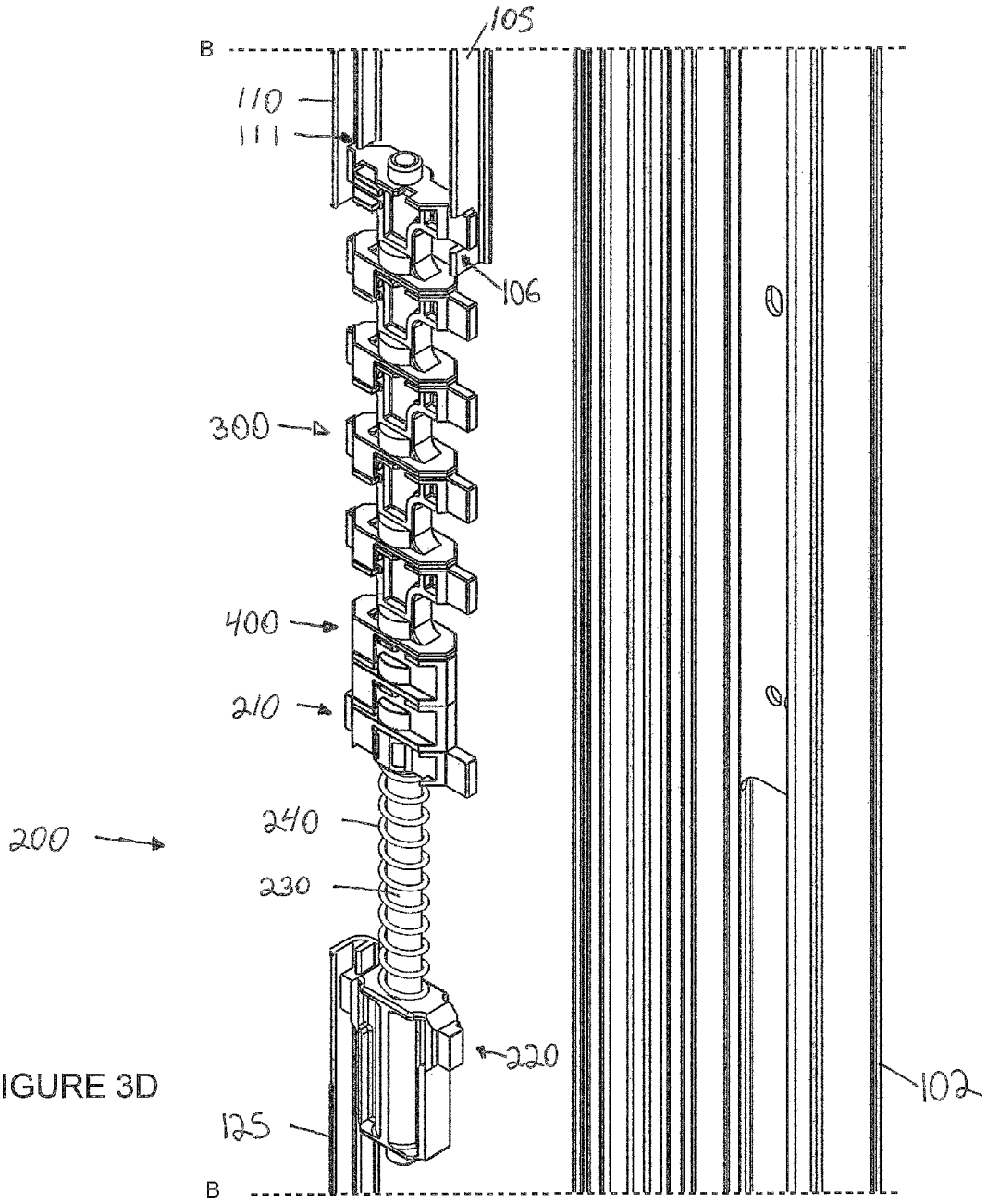
FIG. 3D is a detailed partial-assembled view of the astragal of FIG. 3C between cut-lines B.

Further details of the astragal 100 can be seen in the exploded views shown in FIGS. 3A-3C and the partial exploded view in FIG. 3D. An upper trim cap 130 can be provided on the upper end of the housing 102, and a lower trim cap 132 can be provided on the lower end of the housing 102. The trim caps 130, 132 provide the ends of the astragal 100 with a finished appearance. The upper shoot bolt assembly 150 can include an upper shoot bolt 114, a bolt spring (not shown), and a bolt sleeve 154. The upper shoot bolt assembly 150 is configured such that the bolt sleeve 154 can extend from the housing 102 to contact a head jamb, and the upper shoot bolt 114 can then extend past the bolt sleeve 154 into the head jamb. Similarly, the lower shoot bolt assembly 160 is substantially similar to the upper shoot bolt assembly 150, and includes a lower shoot bolt 116.

As should be understood from FIG. 3A, the upper and lower shoot bolt assemblies 150, 160 can be respectively connected to a pair of slide bars 105, 110. The illustrated embodiment uses a pair of slide bars 105, 110, but a single slide bar may be sufficient. The slide bars 105, 110 of each pair translate along channels formed along opposite sides of the housing 102. The slide bars 105, 110 translate together as a pair, with the one end of each bar connect ed to the respective shoot bolt assembly. The other end of each slide bar 105, 110 is connected to a connection assembly 180 (see FIG. 3C). The connection assembly 180 includes a connector 200 and an optional linkage 275. Particularly, as shown with respect to the lower shoot bolt assembly 160 only the connector 200 is used, and as shown with respect to the upper shoot bolt assembly 150, the linkage 275 is added. The linkage 275 may include one or more primary links 300 with or without one or more secondary links 400. Where a linkage 275 is used, the linkage 275 can then connect to a connector 200.

As best seen in FIG. 3D, the connector 200 comprises a first end 210 configured to connect with links 300, 400 of the linkage 275. As seen in FIG. 3A the first end 210 can also connect with the ends of each slide bar 105, 110. The connector first end 210 can be slidably coupled to a connector second end 220 by a rod 230. The ends 210, 220 of the connector 200 may be biased apart by a connector spring 240. The connector second end 220 is coupled to a drive bar 125 extending from the actuator 122. The drive bar 125 is also housed in a channel at one side of, and slides along, the housing 102, similar to the slide bars 105, 110. Use of the actuator 122 translates the drive bar 125 along the housing 102, which in turn translates the connector 200, the linkage 275 (if present), the pair of slide bars 105, 110, and the respective shoot bolt assemblies 150, 160 to extend or retract the shoot bolts 114, 116. When the upper and lower shoot bolts 114, 116 are extended and are engaged in respective openings in a doorframe, the shoot bolts 114, 116 fix an inactive door panel, to which the astragal 100 is attached, in a closed position within the doorframe.

According to aspects of the present disclosure, the first end 210 of each connector 200 may be indirectly coupled to the slide bars 105, 110 by a linkage 275 made up by one or more selectively removable interlocking primary links 300 and secondary links 400. By increasing or decreasing the number of interlocking links 300, 400 between each of the connectors 200 and their respective slide bars 105, 110, the distance between the shoot bolt assemblies 150, 160 can be increased or decreased, thereby helping to adapt the astragal 100 to doors of different heights. FIG. 3A shows a full length embodiment of the astragal 100 with several links 300, 400 installed. FIG. 3B shows a shortened length embodiment of the astragal 100 with some of the primary links 300 removed. FIG. 3C is a close up of FIG. 3A above cut line A.

Turning to FIGS. 4A-4F, several views of an interlocking primary link 300 are shown. The primary link 300 has a body 302 with a pair of end surfaces 303. The body 302 has a height H1, see FIG. 4C. In one embodiment, H1 is approximately one-inch. The height H1 represents an interval by which the distance between the shoot bolt assemblies 150, 160 may be adjusted by adding or subtracting one primary link 300. By reducing H1, a more fine adjustment of the astragal length can be achieved.

A rotational axis R passes through the body 302 and each end surface 303. Each primary link 300 is configured to interlock with an adjacent primary link 300 with approximately a 90 degree (quarter-turn) rotation about the rotational axis R. The body 302 may include a limiting wall 305 to prevent more than 90 degrees of relative rotation. Less than 90 degrees of relative rotation may be necessary to interlock adjacent primary links 300.

With respect to the rotational axis R, the body 302 comprises a shaft 304 protruding from one end of the body 302 along the rotational axis R and comprises a recess 306 formed into the body 302 at the opposite end thereof, the recess 306 also being along the rotational axis R. Thus the shaft 304 of a first primary link 300 is configured to reside within the recess 306 of an adjacent primary link 300 when a plurality of primary links 300 are joined together.

Figure 4A:
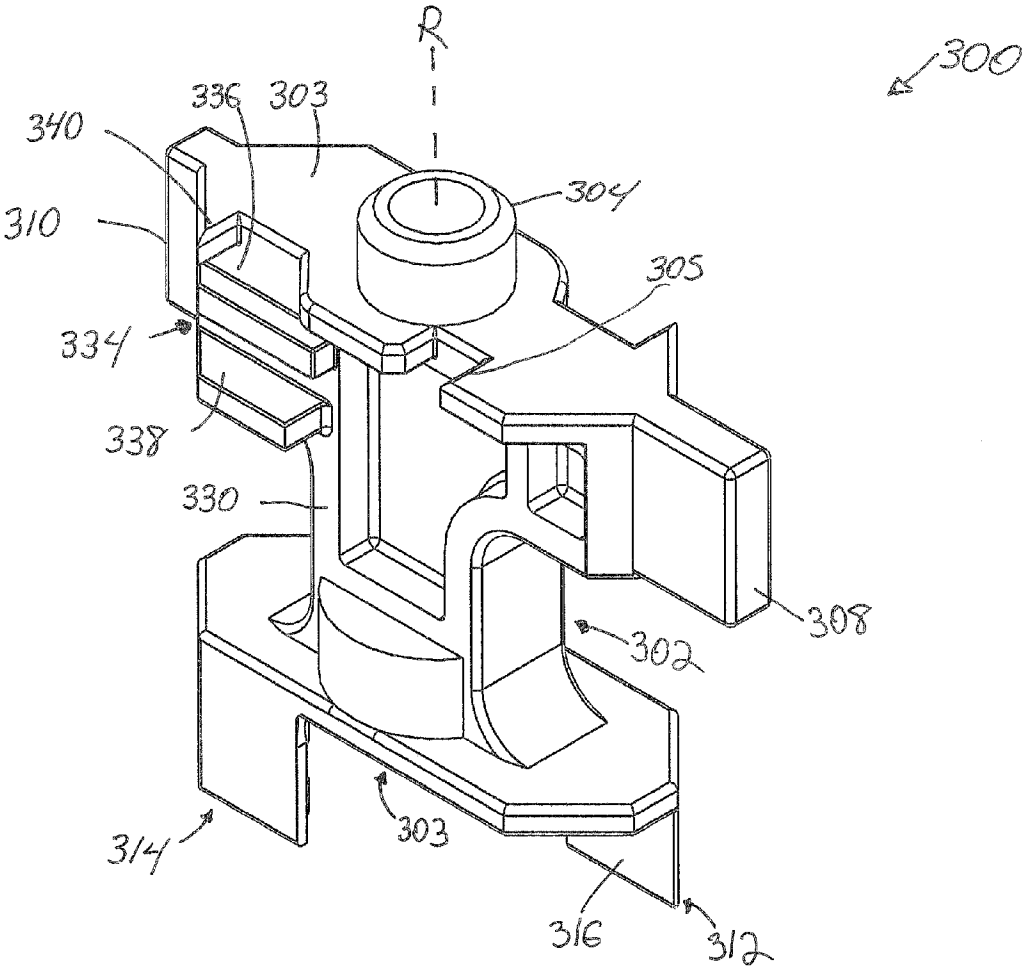
FIG. 4A is a top front perspective view of a link according to a first embodiment thereof.
Figure 4B:
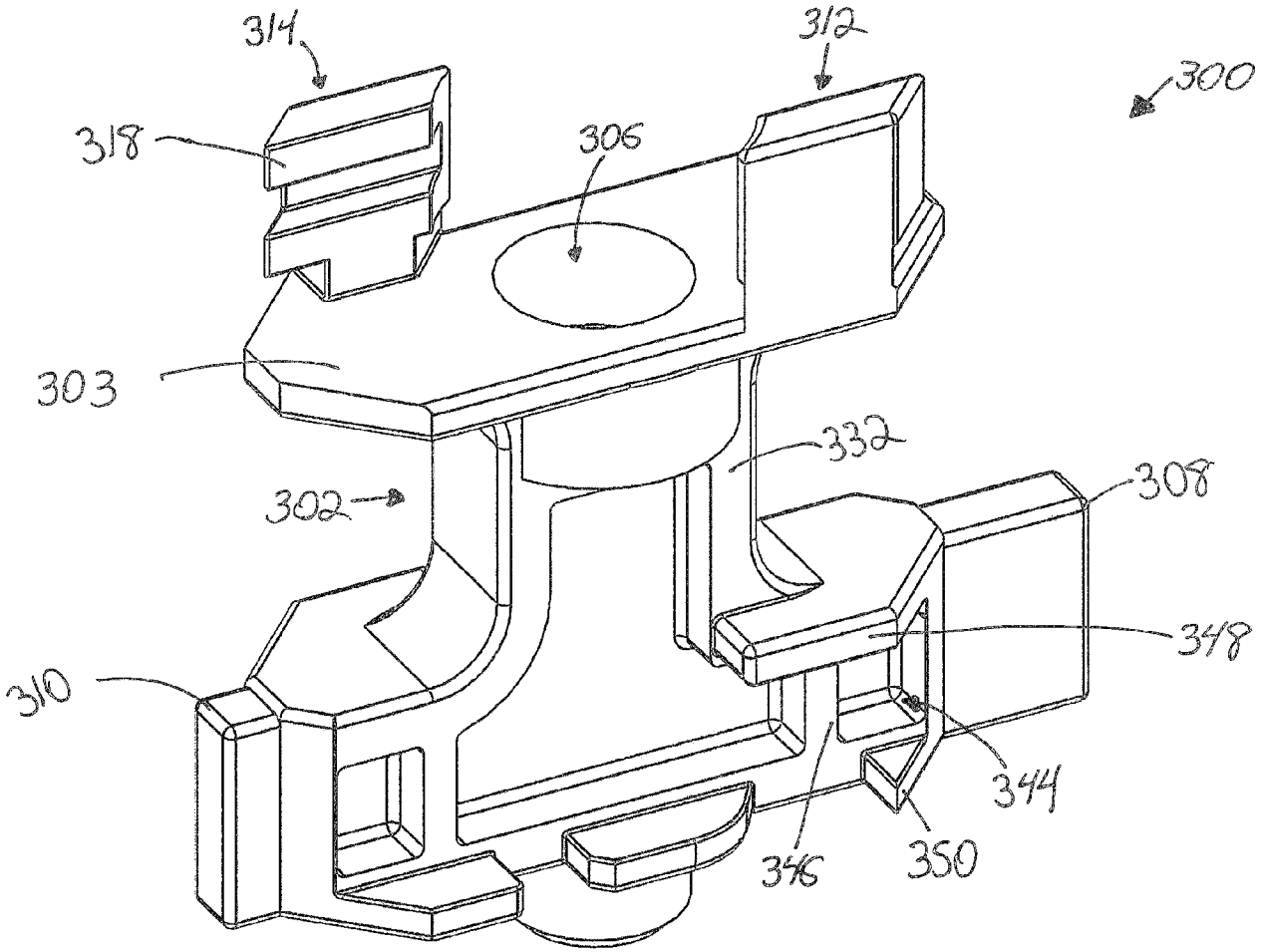
FIG. 4B is a bottom rear perspective view of a link according to the first embodiment thereof.
Figure 4C:
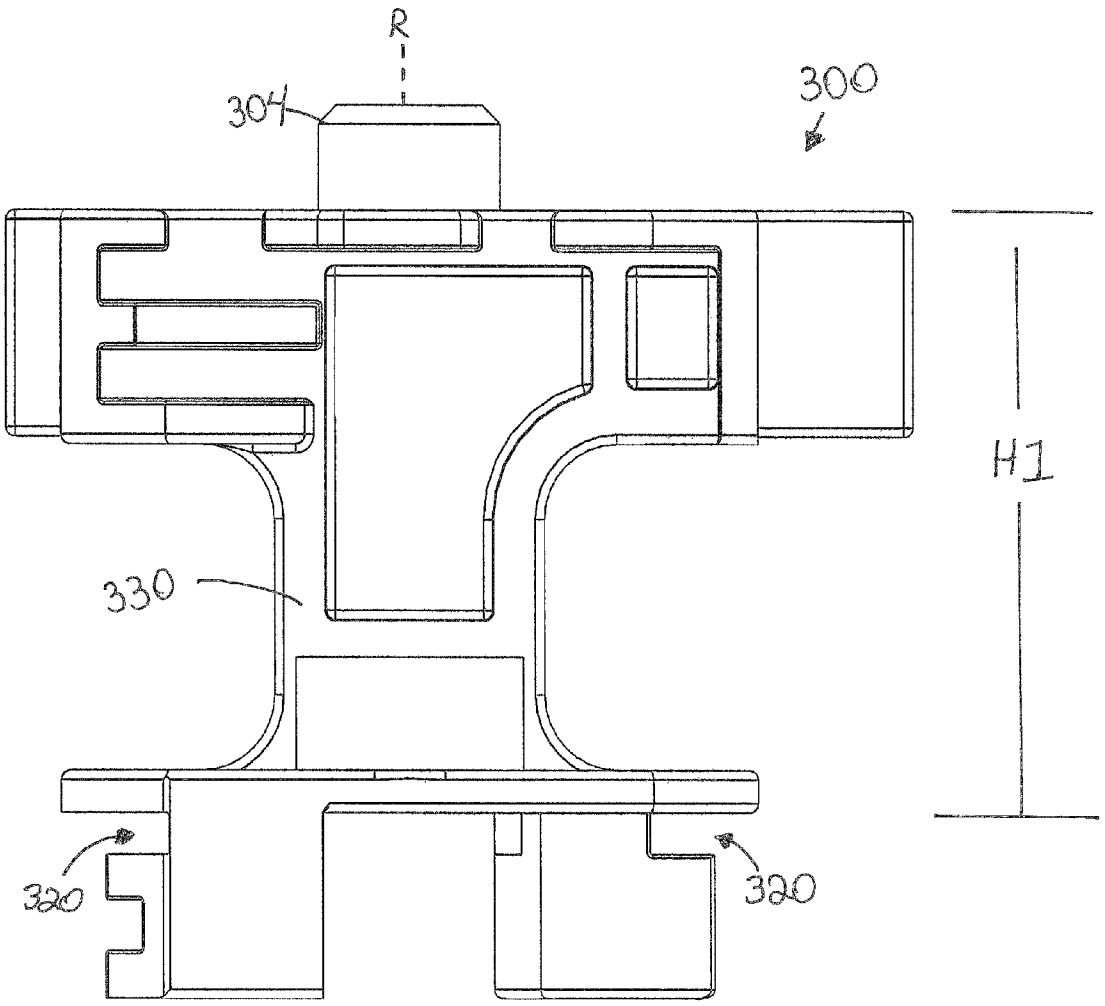
FIG. 4C is a front view of a link according to the first embodiment thereof.
Figure 4D:
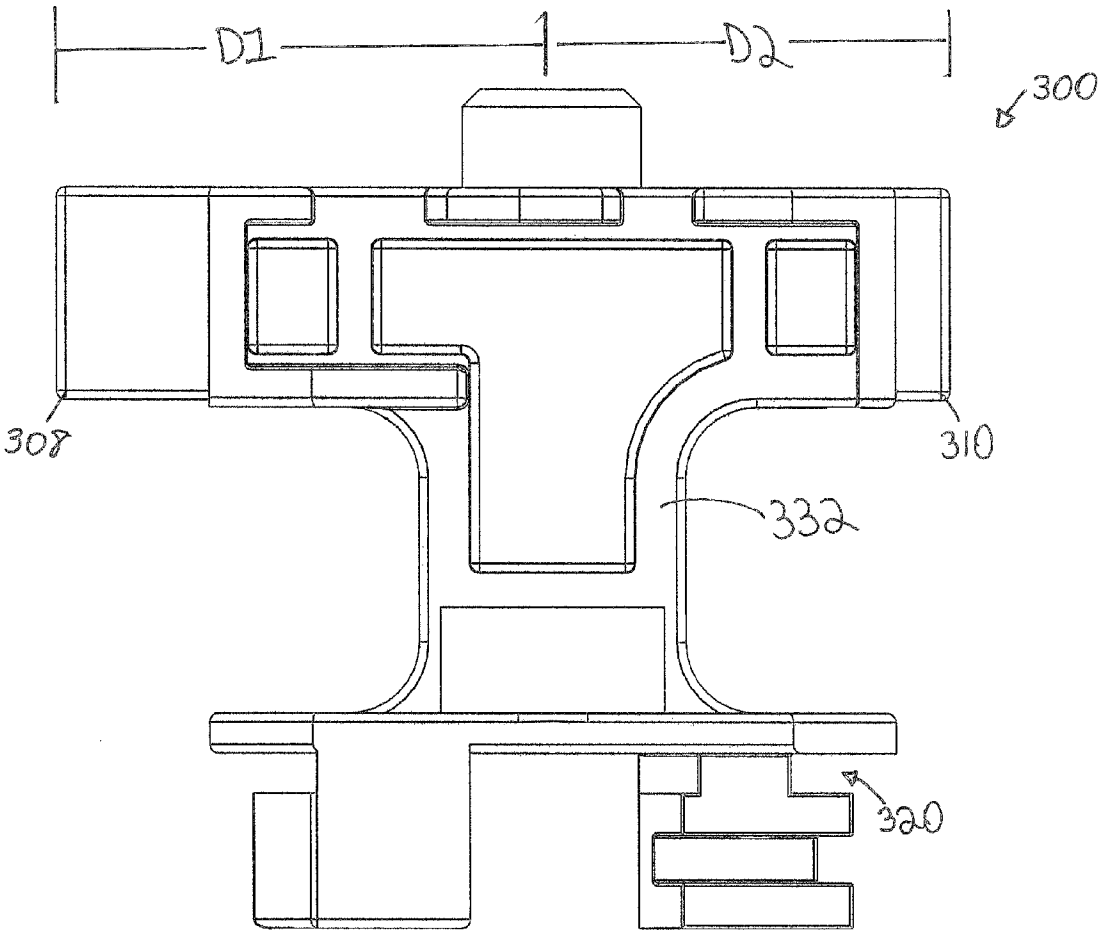
FIG. 4D is a rear view of a link according to the first embodiment thereof.
Figure 4E:
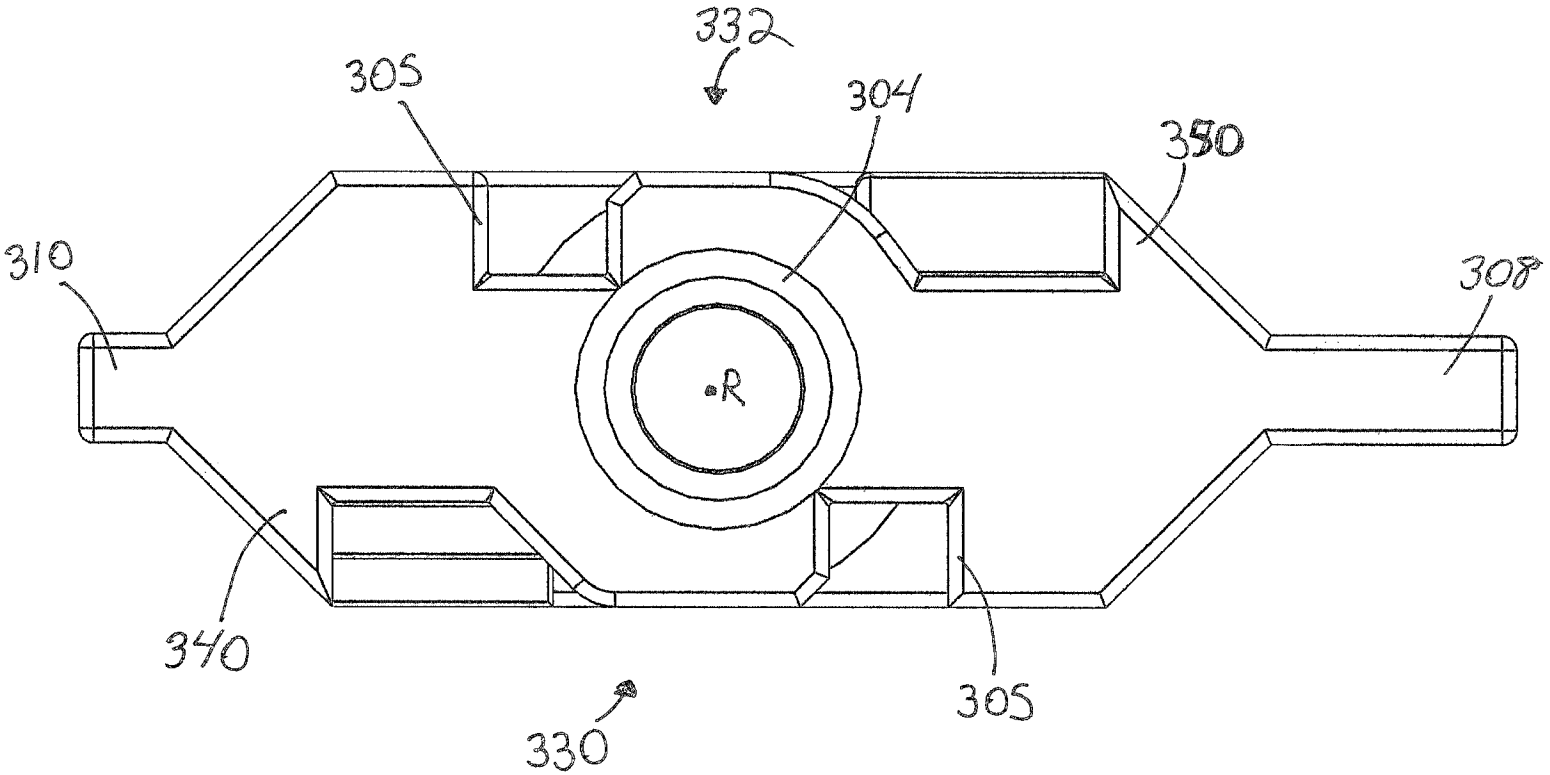
FIG. 4E is a top view of a link according to the first embodiment thereof.

The body 302 further comprises a pair of wings 308 and 310 extending perpendicular to the rotational axis R. As best seen in FIG. 4D, the first wing 308 extends a first distance D1 relative to the rotational axis R and the second wing 310 extends a second distance D2 relative to the rotational axis R. In the illustrated embodiment D1>D2. This asymmetric configuration may assist with assembly of the primary link 300 into the housing 102, but in other embodiments the wings 308, 310 may be mirror symmetric across the rotational axis R. The wings 308 and 310 are configured to couple with respective slide bars 105, 110.

Figure 4F:
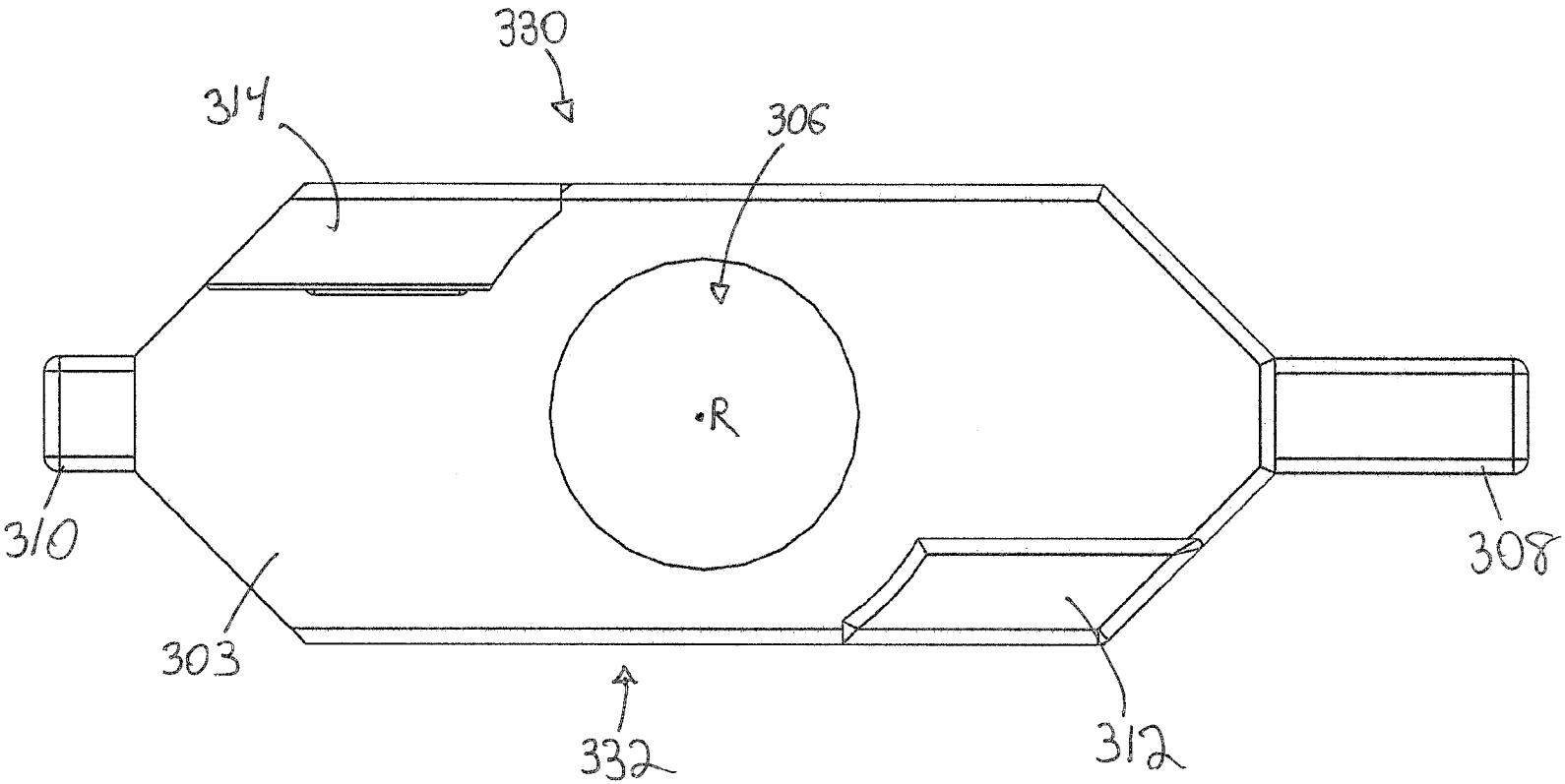
FIG. 4F is a bottom view of a link according to the first embodiment thereof.
Figure 5A:
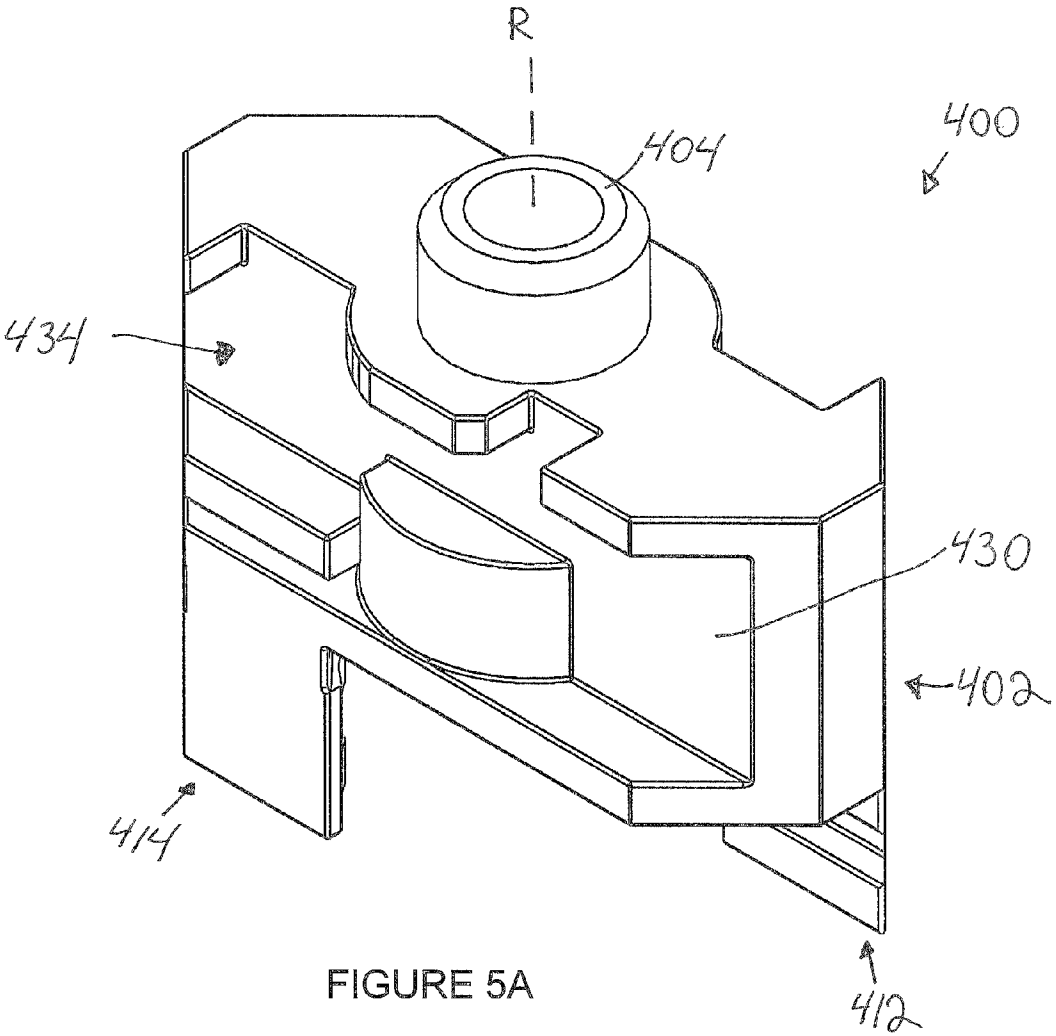
FIG. 5A is a top front perspective view of a link according to a second embodiment thereof.
Figure 5B:
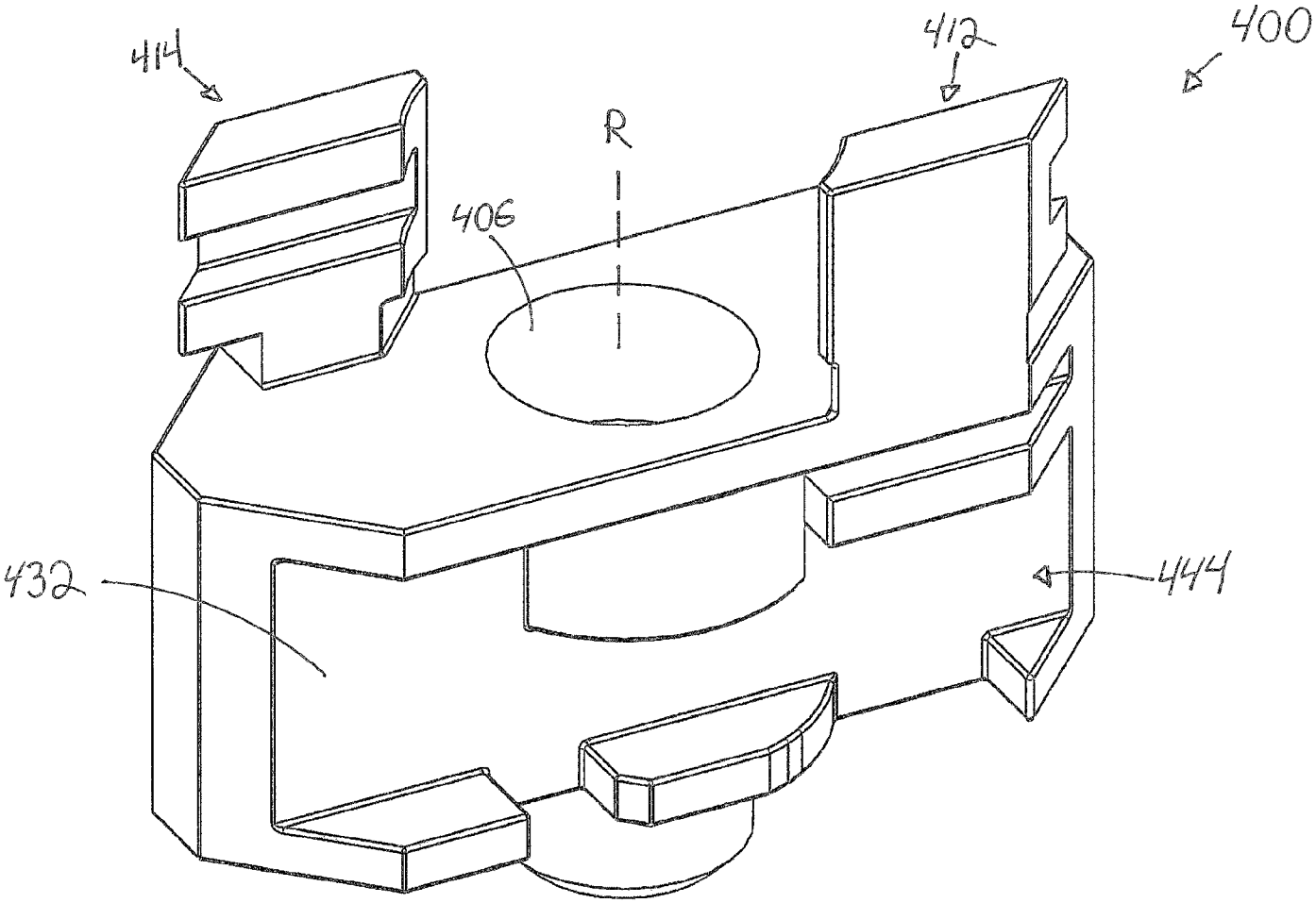
FIG. 5B is a bottom rear perspective view of a link according to the second embodiment thereof.
Figure 5C:
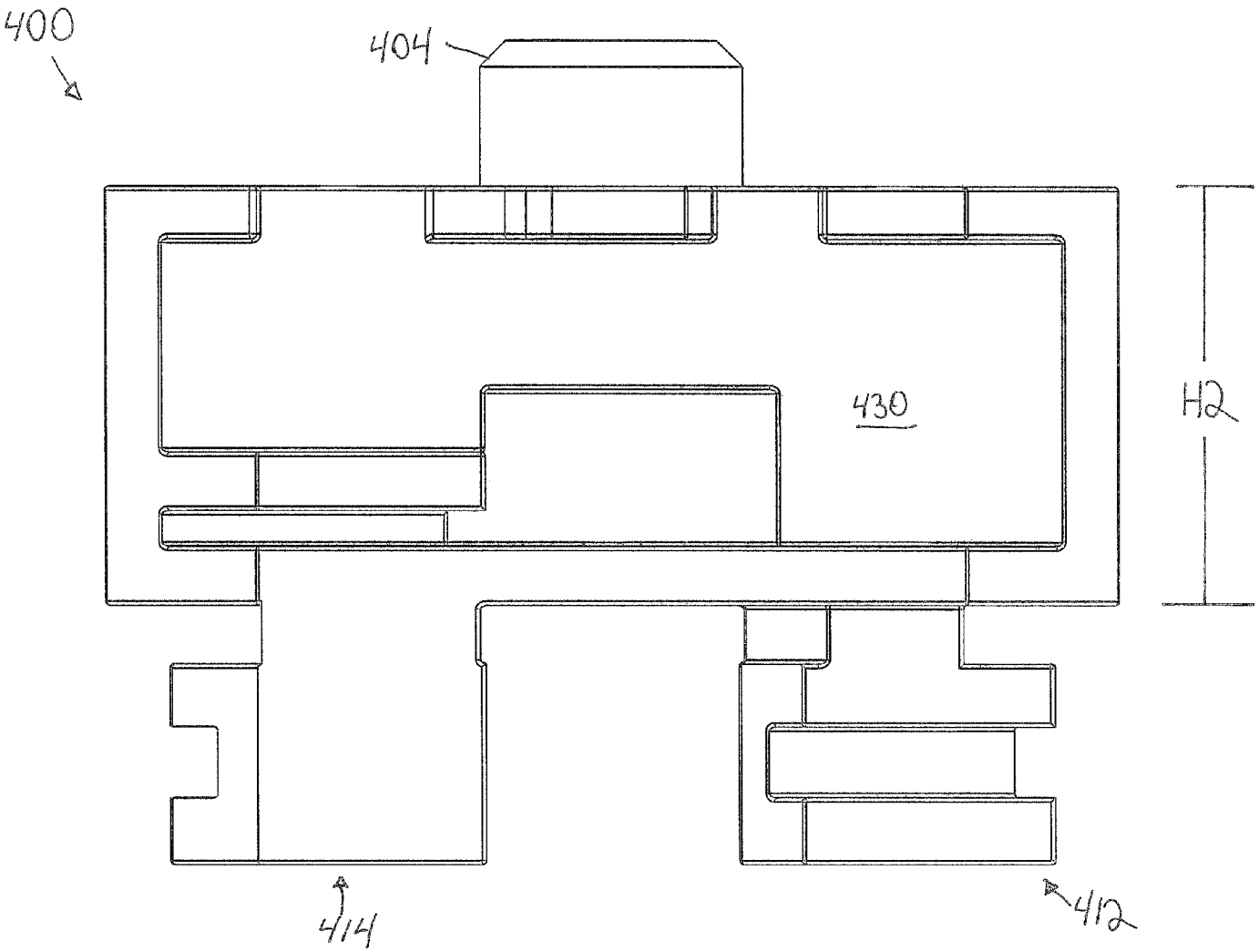
FIG. 5C is a front view of a link according to the second embodiment thereof.
Figure 5D:
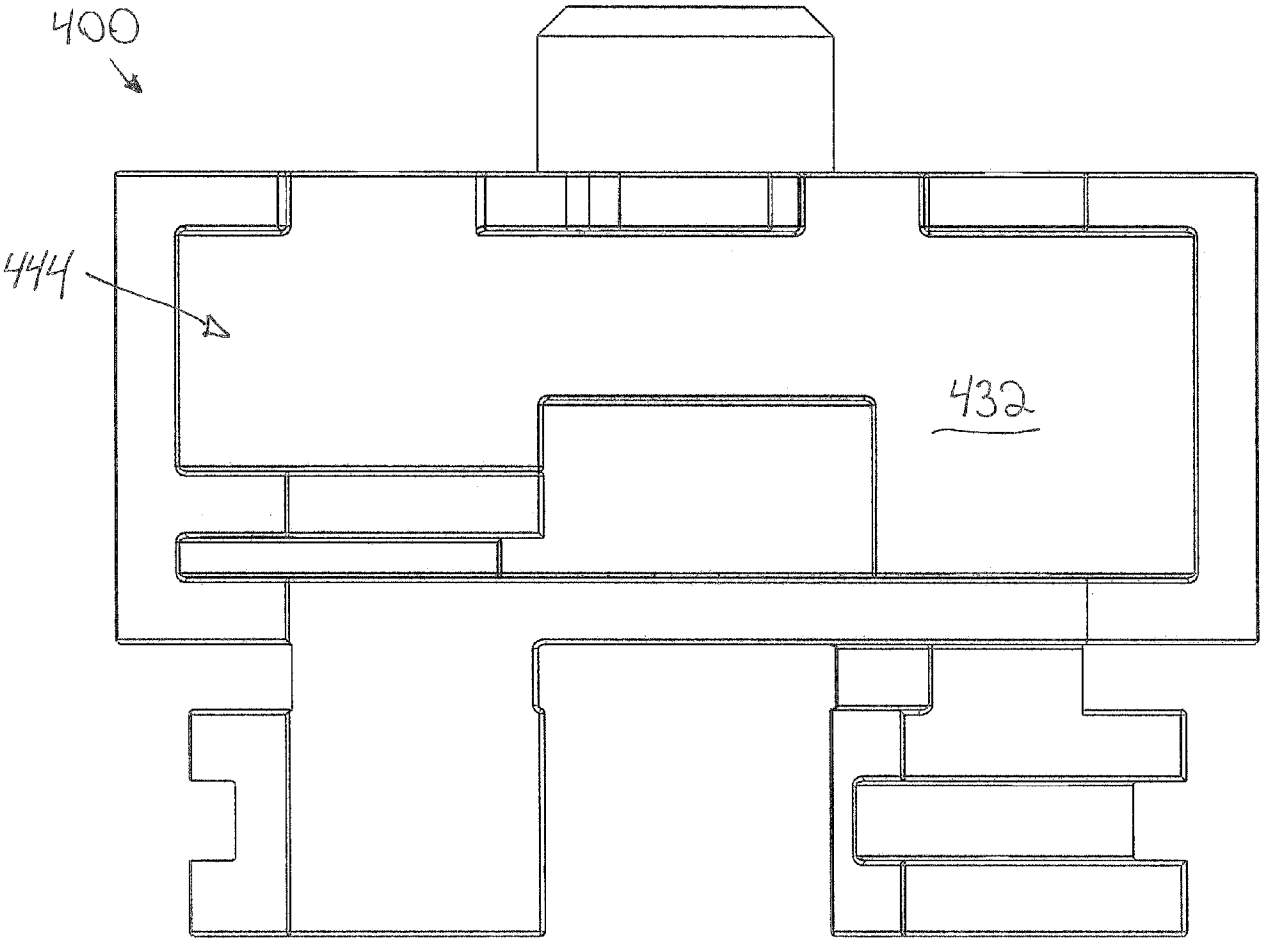
FIG. 5D is a rear view of a link according to the second embodiment thereof.
Figure 5E:
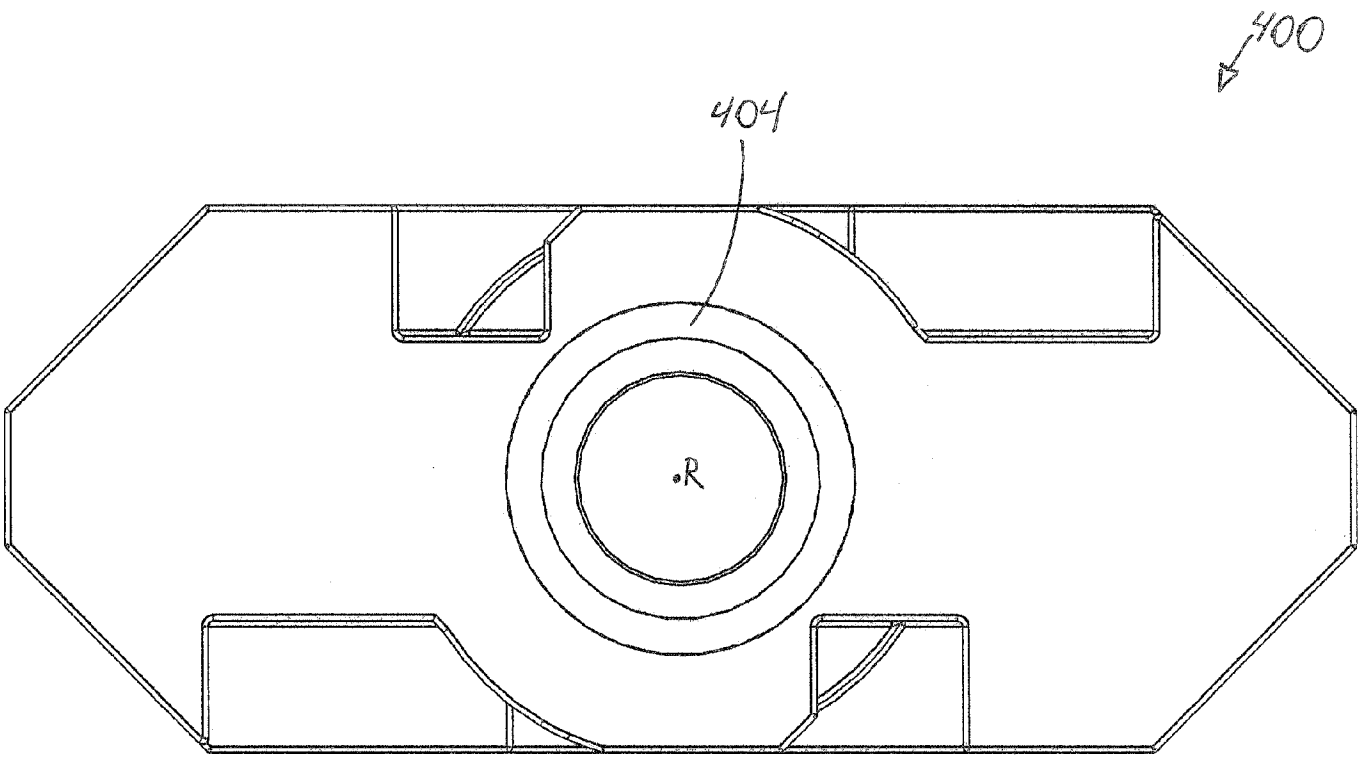
FIG. 5E is a top view of a link according to the second embodiment thereof.
Figure 5F:
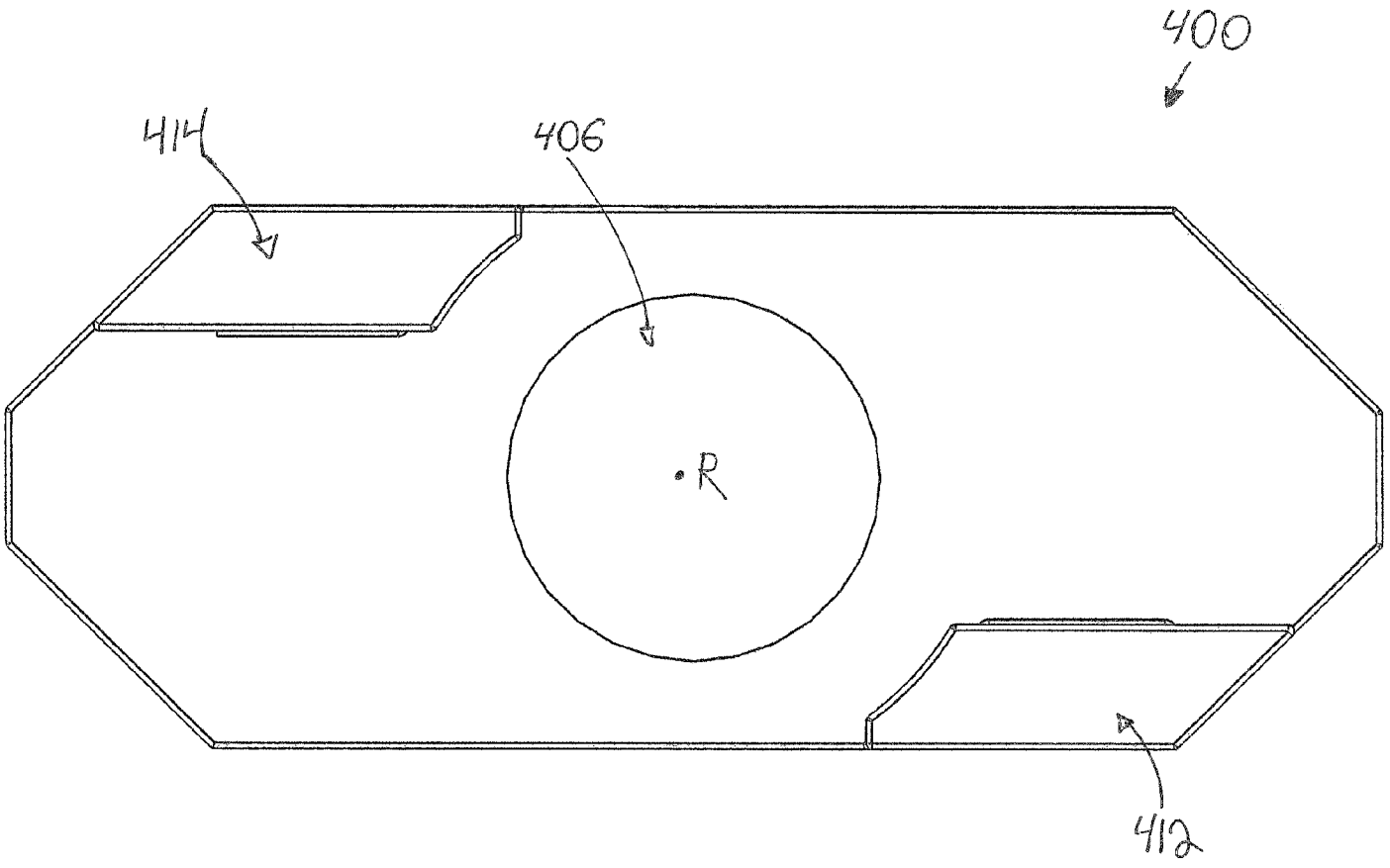
FIG. 5F is a bottom view of a link according to the second embodiment thereof.

With respect to the rotational axis R, one end of the body 302 includes a pair of tabs 312, 314 offset from the rotational axis R, but extending outwardly from the body 302 along the direction of the rotational axis R. In the illustrated embodiment, the tabs 312, 314 extend from the end of the body 302 having the recess 306. As best seen in FIG. 4F, the tabs 312, 314 are positioned rotationally symmetric to one another with respect to the rotational axis R. In some embodiments, the first tab 312 has a flat abutment surface 316 and the second tab 314 includes a grooved abutment surface 318, thereby providing a plurality of teeth. Each tab 312, 314 also includes a slot 320 formed therein, see FIG. 4C. Each slot 320 is adjacent to the respective end of the body 302 and extends into each tab 312, 314 in a direction toward and perpendicular to the rotational axis R.

The body 302 further defines a front side 330 and a back side 332. The front side 330 may be rotationally symmetric to the back side 332 about the rotational axis R. However, in the illustrated embodiment, the front side 330 is similar to but not exactly rotationally symmetric to the back side 332. The front side 330 includes a front clamping pocket 334. The front clamping pocket 334 includes a front clamping surface 336 generally along the front side 330. The front clamping pocket 334 also includes a front stop wall 338 positioned normal to the front clamping surface 336, offset from an end of the body 302. The front clamping pocket 334 also includes a front protrusion 340 extending normal to the front clamping surface 336 positioned adjacent to an end of the body 302.

The front clamping pocket 334 of a first primary link 300 is configured to interlock with the second tab 314 of an adjacent primary link 300. In the interlocked position, the second tab 314 resides between the front stop wall 338 and the front protrusion 340, the grooved abutment surface 318 contacts the front clamping surface 336, which can be oppositely grooved to mesh with the grooved abutment surface 318, and the front protrusion 340 protrudes into the slot 320. Engagement between the front protrusion 340 and the slot 320 helps prevent adjacent primary links 300 from separating along the direction of the rotational axis R when the adjacent primary links 300 are interlocked. Therefore interlocked links are able to translate together along the housing 102 in response to use of the actuator 122.

The back side 332 includes a back clamping pocket 344. The back clamping pocket 344 includes a back clamping surface 346 generally along the back side 332, a back stop wall 348 generally normal to the back clamping surface 346 and a back protrusion 350 extending normal to the back clamping surface 346. Therefore the back clamping pocket 344 should be understood to be similar to the front clamping pocket 334. The back clamping pocket 344 of a first primary link 300 is configured to interlock with the first tab 312 of an adjacent primary link 300. In the interlocked position, the first tab 312 resides between the back stop wall 348 and the back protrusion 350, the smooth abutment surface 316 contacts the back clamping surface 346, and the back protrusion 350 protrudes into the slot 320 of the second tab 314. Engagement between the back protrusion 350 and the slot 320 helps prevent adjacent links from separating along the direction of the rotational axis R when the adjacent links 300 are interlocked.

Turning to FIGS. 5A-5F, several views of a secondary link 400 are shown. The secondary link 400 includes many of the same features, and represents an additional embodiment, as the primary links 300. The secondary link 400 has a body 402, with a second height H2 (see FIG. 5C) defined along the rotational axis R thereof. The second height H2 is less than the first height H1 of the primary links 300. Therefore secondary links 400 may be used to make finer adjustments in the length of the astragal 100. In one embodiment, H2 is approximately one-half inch. The secondary link 400 of the illustrated embodiment is configured to be used in combination with primary links 300 because the secondary link 400 shown does not include wings. Therefore the secondary links 400 are not configured to directly connect with the slide bars 105, 110. One skilled in the art would recognize that wings may be added to the secondary links 400 as shown on the primary links 300, in which case a plurality of secondary links 400 may be used without any primary links 300.

Again, the secondary links 400 have many of the same features as the primary links 300. Therefore the secondary links 400 also include a shaft 404, a recess 406, and a pair of tabs 412, 414. The secondary links 400 also include a front and back side 430, 432 each having a clamping pocket 434, 444 with an abutment surface, stop wall and protrusion. Each present portion of the secondary links 400 may be understood as substantially similar to related portions of the primary links 300. However, in the illustrated embodiment, the secondary link 400 is 180 degrees rotationally symmetric around the rotational axis R, while the illustrated primary link 300 was not.

Figure 6:
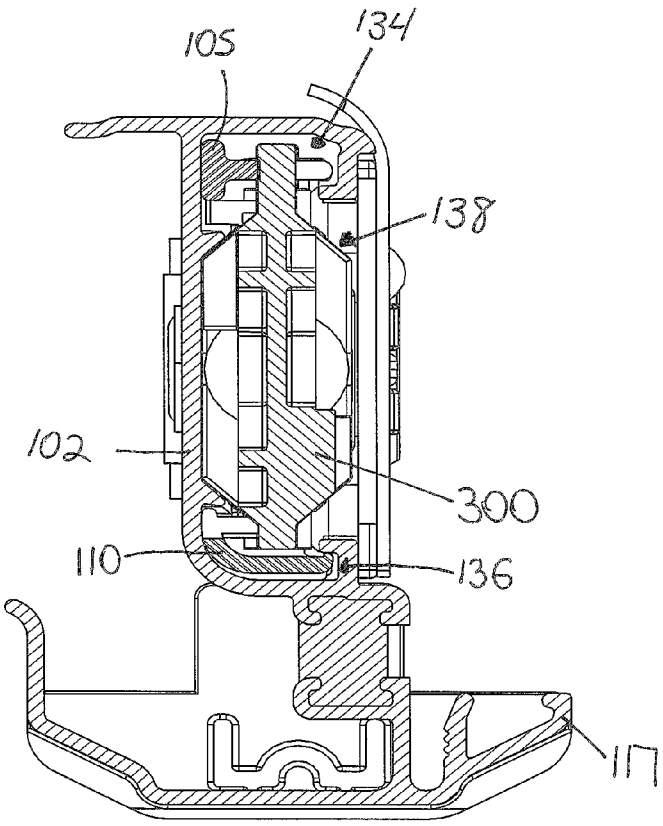
FIG. 6 is a cross-sectional view of the assembled astragal of FIG. 2 through line VI-VI.

FIG. 6 shows a cross-sectional profile of one embodiment of an astragal 100 having a housing 102. The housing 102 can be configured for attachment along a non-hinged vertical edge of an inactive door panel. An outwardly extending edge portion 117 of the housing 102 provides a stop for a cooperating active door panel. A resilient seal (not shown) can be attached along the edge portion 117 to provide a weather seal between the astragal 100 and an associated swinging active door panel. As seen from FIG. 6, the housing 102 provides a first channel 134 along one side thereof, for slidably accommodating the first slide bars 105. The first channel 134, and particularly the first slide bars 105, may be described as having a T-shaped cross-section. The housing 102 also provides a second channel 136 along an opposite side thereof, for slidably accommodating the second slide bars 110. The second channel 136, and particularly the second slide bars 110, may be described as having a J-shaped cross-section.

The first channel 134 is spaced from the second channel 136 by a cavity 138. As seen in FIG. 6, the profile of the primary link 300 (and the secondary link, though not shown) is configured to correspond with the cross-section of the cavity 138. The corresponding shapes allow the links 300, 400 to slide along the length of the astragal 100, but also limit rotation of each link 300, 400 about their rotational axis R. Rotation is particularly limited once the links 300, 400 are installed within the housing 102 and the cavity 138 is closed by trim plates 128.

Referring back to FIG. 3D, connection of the primary links 300 to the slide bars 105, 110 is now further described. The first, T-shaped slide bars 105 include an aperture 106 formed there through. The aperture 106 is formed proximate to an end of each of the first slide bars 105. The second, J-shaped slide bars 110 include at least one notch 111 formed in an edge thereof, where the notches 111 are also proximate to the end of the second slide bars 110.

In the illustrated embodiment, a primary link 300 is connected to each of the slide bars 105, 110 by first inserting the first wing 308 through the aperture 106, and then fitting the second wing 310 into the notch 111. As shown, the wings of the end most link 300 of the linkage 275 are used to connect with the slide bars 105, 110. As should be understood, the ends of the two drive bars 125 opposite the actuator 122 may also include one of an aperture 106 and a notch 111. The second end 220 of each connector 200 may include wings substantially similar to those of the primary link 300 to couple a respective connector 200 to a respective drive bar 125. The first end 210 of the connectors 200 may be configured to include clamping pockets substantially similar to those of the primary link 300 in order for the connector 200 to be coupled to a distal one of the plurality of links 300, 400 in the linkage 275.

According to some embodiments of the present disclosure, the astragal 100 can facilitate a method of fitting the astragal 100 to doors of varying heights. According to these embodiments, the astragal 100 would be provided with a housing 102 having a length equal to the height of one of the tallest commonly available doors, such as 96-inch tall doors. The astragal 100 as provided could include a plurality of interlocking primary links 300 and secondary links 400 preloaded between respective slide bars 105, 110 and connectors 200, thereby providing the astragal 100 in a ready-to-mount configuration for tall doors.

Then, if mounting the astragal 100 to shorted doors is desired, the astragal 100 can be modified without being fully replaced. Avoiding the full replacement, or need for a completely separate astragal 100, can reduce costs by reducing the need to keep various length astragals in inventory. The process of modifying the astragal 100 to a shorter height can include one or more of the following steps:

removing trim plates 128;

removing the second wing 310 of at least one primary link 300 from the notch 111 of the second slide bar 110;

removing the first wing 308 of the primary link 300 from the aperture 106 of the first slide bar 105;

removing a plurality of the primary links 300 and/or secondary links 400 from the chamber 138;

separating one or more of the links 300, 400 from the plurality thereof (i.e., the linkage) to shorten the chain of links 300, 400 by the desired amount;

removing one or both trim caps 130, 132;

removing one or more bars 105, 110, 125 from the housing 102;

cutting one end of the housing 102 to remove the extra length thereof;

reassembling the astragal 100, this time with fewer, if any, links 300, 400 between the slide bars 105, 110 and the connectors 200.

The above descriptions of preferred embodiments of the invention are intended to illustrate various aspects and features of the invention without limitation. Persons of ordinary skill in the art will recognize that certain changes and modifications can be made to the described embodiments without departing from the scope of the invention. For example, while the invention has been described for use with swinging door panels, a locking system according to the invention can also be applied to casement window panels and casement window frames, or the like. All such changes and modifications are intended to be within the scope of the appended claims.

What is claimed is:

1. At least two links capable of interlocking with one another for removable use in an adjustable length astragal, each of the at least two links comprising:

a body having a front side, a back side, a first end surface, a second end surface, and a rotational axis passing through each of the end surfaces;

a pair of tabs extending from the first end surface, offset from the rotational axis;

a front clamping pocket formed on the front side;

a back clamping pocket formed on the back side;

a wing extending from the body on each side of the rotational axis, the wings extending perpendicular to the rotational axis;

wherein at least one of the wings connects at least one of the at least two links to a slide bar within an astragal; and wherein rotation of the body of a first link of the at least two links, about the rotational axis, relative to the body of a second link of the at least two links, interlocks the first link with the second link such that each tab of the pair of tabs of the first link engages a respective one of the front and back clamping pockets of the second link.

2. The at least two links according to claim 1, each link further comprising:

a shaft extending from the second end surface along the rotational axis; and a recess formed into the first end surface along the rotational axis, wherein the shaft of the first link would engage the recess of the second link or vice versa.

3. The at least two links according to claim 1, wherein one of the wings of each link extends a distance D1 from the rotational axis and another of the wings of each link extends a distance D2 from the rotational axis, wherein D1 is not equal to D2.

4. The at least two links according to claim 1, wherein, for each link, each clamping pocket comprises:

a clamping surface extending along a respective side of the body;

a stop wall extending normal to the clamping surface and offset from the end surfaces of the body; and a protrusion extending normal to the clamping surface adjacent to one of the end surfaces of the body.

5. The at least two links according to claim 4, wherein, for each link, the tabs each comprise:

a slot formed into each tab, the slot positioned adjacent to the first end surface of the body and extending in a direction perpendicular to the rotational axis, wherein, when the first link is interlocked with the second link, the protrusion of each clamping pocket engages the respective slot of the respective tab to help prevent the interlocked links from separating along the direction of the rotational axis.

6. The at least two links according to claim 1, wherein, for each link, each tab has an abutment surface, the abutment surface of a first tab being flat and the abutment surface of a second tab being grooved.

7. The at least two links according to claim 6, wherein one of the front clamping pocket and the back clamping pocket of each link includes a grooved clamping surface configured to mesh with the grooved abutment surface of the second tab.

8. The at least two links according to claim 1, wherein interlocking the at least two links prevents axial separation, and unlocking the at least two links allows axial separation.

9. An adjustable length astragal, comprising:

a housing;

an upper shoot bolt and a lower shoot bolt positioned adjacent opposite ends of the housing;

an actuator attached to the housing, connected to and configured to simultaneously extend or retract the upper and lower shoot bolts; and an adjustable connection assembly provided between the actuator and at least one of the shoot bolts, where the connection assembly adjusts the distance between the actuator and the respective shoot bolt in each of the respective shoot bolt's extended and retracted positions, wherein the adjustable connection assembly comprises:

a linkage between the actuator and at least one of the shoot bolts, the linkage comprising:

at least two selectively removable interlocking links, wherein the at least two links can be selectively added or removed to adjust the distance between the actuator and the respective shoot bolt, wherein the at least two links interlock by rotational motion relative to one another.

10. The astragal according to claim 9, further comprising:

a drive bar extending from the actuator to one end of the linkage; and a pair of slide bars extending from the other end of the linkage, along opposite sides of the housing, to the respective shoot bolt.

11. The astragal according to claim 10, wherein the connection assembly further comprising a connector, the connector disposed between the drive bar and the linkage, wherein the connector comprises:

a first connector end configured to interlock with a first link of the at least two links of the linkage;

a second connector end configured to connect with the drive bar; and a spring disposed between the first and second connector ends biasing the connector ends apart.

12. The astragal according to claim 9, wherein the at least two interlocking links comprise: a primary link having a first height H1 and a secondary link having a second height H2, wherein H1 is greater than H2.

13. The astragal according to claim 9, wherein each of the at least two links comprises:

a body having a front side, a back side, a first end surface, a second end surface, and a rotational axis passing through each of the end surfaces;

a pair of tabs extending from the first end surface, offset from the rotational axis;

a front clamping pocket formed on the front side;

a back clamping pocket formed on the back side;

wherein each tab of the pair of tabs of a first link engages and disengages a respective one of the front and back clamping pockets of a second link with relative rotation about the rotational axis.

14. The astragal according to claim 13, wherein each of the at least two links further comprise:

a shaft extending from the second end surface along the rotational axis; and a recess formed into the first end surface along the rotational axis, wherein the shaft of the first link would engage the recess of the second link or vice versa.

15. The astragal according to claim 13, wherein at least one of the at least two links further comprise:

a wing extending from the body on each side of the rotational axis, the wings extending perpendicular to the rotational axis, wherein the wings are configured for connecting the link to a slide bar within the astragal.

16. The astragal according to claim 15, wherein the at least one of the at least two links comprise:

one of the wings extending a distance D1 from the rotational axis and another of the wings extending a distance D2 from the rotational axis, wherein D1 is not equal to D2.

17. The astragal according to claim 13, wherein the front clamping pocket and the back clamping pocket of at least one of the at least two links further comprise:

a clamping surface extending along a respective side of the body;

a stop wall extending normal to the clamping surface and offset from the end surfaces of the body; and a protrusion extending normal to the clamping surface adjacent to one of the end surfaces of the body.

18. The astragal according to claim 17, wherein the pair of tabs of the at least two links further comprise:

a slot formed into each tab, the slot positioned adjacent to the first end surface of the body and extending in a direction perpendicular to the rotational axis, wherein when the first link is interlocked with the second link, the protrusion of each clamping pocket engages the respective slot of the respective tab to help prevent the links from separating along the direction of the rotational axis.

19. The astragal according to claim 13, wherein at least one of the at least two links further comprises:

each tab having an abutment surface, the abutment surface of a first tab being flat and the abutment surface of a second tab being grooved.

20. The astragal according to claim 19, wherein the at least two links further comprise: one of the front clamping pocket and the back clamping pocket including a grooved clamping surface configured to mesh with the grooved abutment surface of the second tab.

21. The astragal according to claim 9, wherein relative motion between the at least two selectively removable interlocking links is prevented when installed in the housing.

* * * * *